US005401367A

United States Patent [19]

Traini et al.

[11] Patent Number: 5,401,367

[45] Date of Patent: Mar. 28, 1995

[54] CHLOR-ALKALI DIAPHRAGM ELECTROLYSIS PROCESS AND RELEVANT CELL

[75] Inventors: Carlo Traini; Giovanni Meneghini, both of Milan, Italy

[73] Assignee: De Nora Permelec S.p.A., Italy

[21] Appl. No.: 189,108

[22] Filed: Jan. 31, 1994

[30] Foreign Application Priority Data

Feb. 12, 1993 [IT] Italy ..... MI93A0256

[51] Int. Cl.[6] ..... C25B 1/16; C25B 9/00

[52] U.S. Cl. ..... 204/98; 204/128; 204/266; 204/129; 204/232; 204/237

[58] Field of Search ..... 204/98, 128, 257, 258, 204/263, 265, 237, 232

[56] References Cited

U.S. PATENT DOCUMENTS 4,169,773 10/1979 Lai et al. ..... 204/129
4,772,364 9/1988 Dempsey et al. ..... 204/98
4,946,568 8/1990 Hakansson ..... 204/98
5,066,378 11/1991 Meneghini ..... 204/258

*Primary Examiner*—Kathryn Gorgos
*Attorney, Agent, or Firm*—Bierman and Muserlian

[57] ABSTRACT

In a process of chlor-alkali electrolysis carried out in a diaphragm cells comprising pairs of interleaved anodes and cathodes, the cathodes being provided with openings and coated with a porous diaphragm resistant to corrosion, at least part of the said anodes being provided with hydrodynamic circular to produce circulation of the anodic brine, the cell having inlets for feeding the fresh brine, and outlets for the removal of produced chlorine, hydrogen and caustic, the improvement comprising controlling the oxygen content in the chlorine and chlorate concentration in the caustic independently from the the fresh brine introduced and the concentration of the the brine by adding an aqueous solution of hydrochloric acid to the brine in the anodic compartment of the cell through a distributor positioned over the hydrodynamic circulator.

17 Claims, 1 Drawing Sheet

CHLOR-ALKALI DIAPHRAGM ELECTROLYSIS PROCESS AND RELEVANT CELL

STATE OF THE ART

Figure 1:
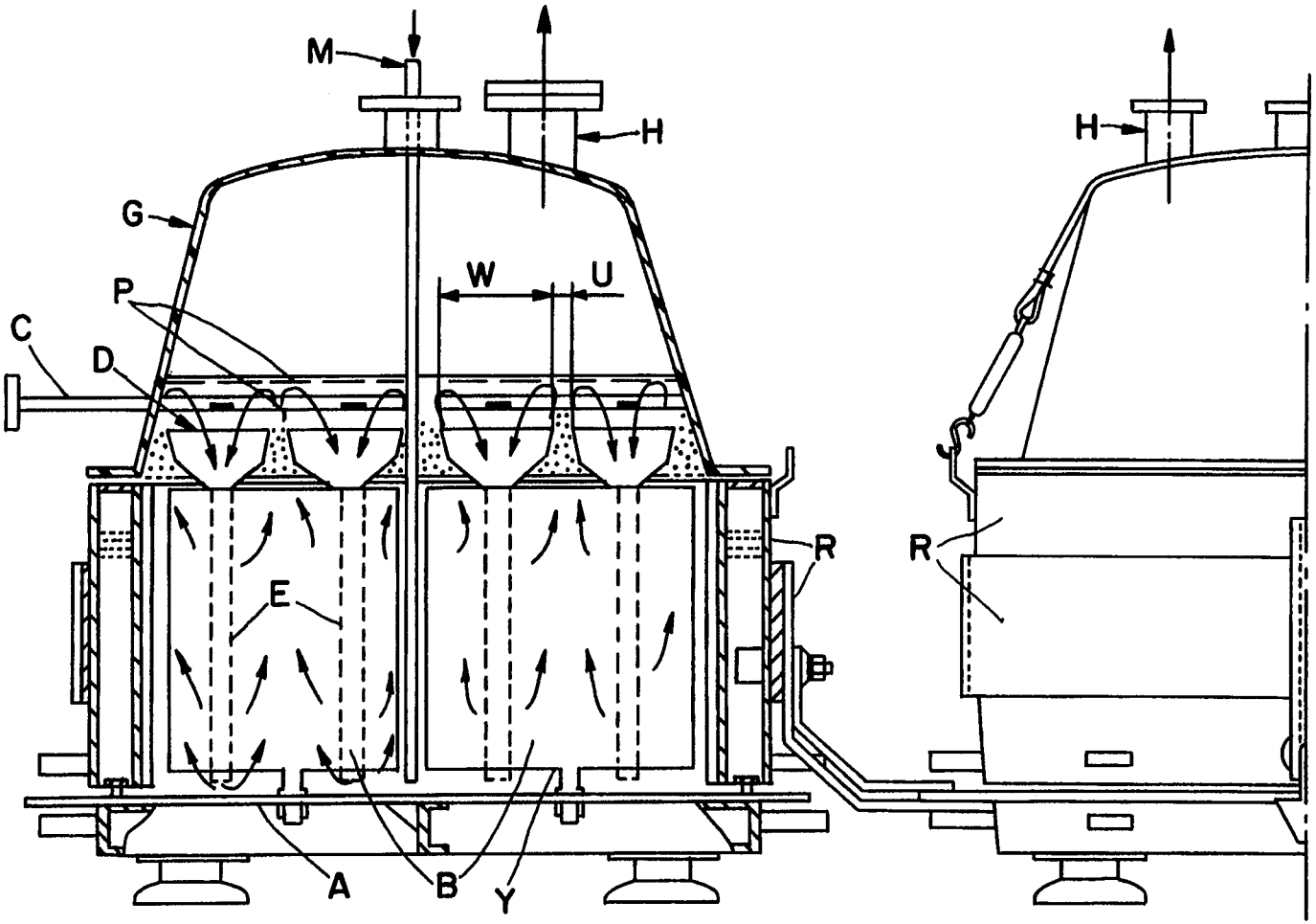

The control of the amount of oxygen in chlorine produced by the electrolysis of brine in a diaphragm electrolytic cell is a serious problem. The oxygen content in chlorine is a direct function of the amount of caustics that back-migrate through the diaphragm from the cathodic compartments to the anodic compartments. In addition, the reaction of caustics with chlorine allows for the production of hypochlorite in the brine. As the brine flows through the diaphragms in the cathodic compartment to form a solution of caustic and sodium chloride, it is evident that this solution is polluted with the chlorates produced by the dismutation of hypochlorite favored by the high operation temperature. Back-migration of caustics, which is unavoidable with diaphragm cells, is further enhanced by depletion of brine close to the diaphragm. For this reason an improved operation of diaphragm cells was obtained by installing onto the anodes of said cells a hydrodynamic means described in U.S. Pat. No. 5,066,378. In fact, said means allow for high internal recirculation of brine, thus efficaciously avoiding the formation of low concentration areas.

The hydrogen content in the produced chlorine is a further serious problem affecting the diaphragm cells. According to the current knowledge, one of the causes for hydrogen in chlorine is the presence of iron in the feed brine. Iron is reduced at the cathodes with consequent growth of dendrites of metal iron or conductive oxides such as magnetite. When tipes of the dendrites come out of the diaphragm on the brine side, they behave as tiny cathodic areas able to produce hydrogen directly in the anodic compartment.

OBJECTS OF THE INVENTION

It is an object of the invention to provide an improved process for the electrolysis of brine with complete control of the oxygen content in the chlorine, of the chlorates in the produced caustic and of the formation of hydrogen in the anodic compartments.

It is an object of the invention to provide an improved diaphragm electrolysis cells suitable for the process of the invention.

These and other objects and advantages of the invention will become obvious from the following detailed description.

THE INVENTION

The novel process of the invention for the electrolysis of brine to produce chlorine in a diaphragm cell provided with pairs of interleaved anodes and cathodes; the cathode being provided with openings and coated with a porous diaphragm resistant to corrosion; the anode being either expandable or non-expandable; at least a portion of the anodes being provided with hydrodynamic means to produce circulation of the anodic brine; the cell being provided with inlets for feeding fresh brine and outlets for the removal of chlorine and for hydrogen and caustic comprises controlling the oxygen content in the chlorine and the chlorate concentration in the caustic independently from both the flow rate and concentration of the fresh brine by adding aqueous hydrochloric acid to the cell through a distributor positioned over the hydrodynamic means. Preferably, the electrolysis cells are those described in U.S. Pat. No. 5,066,378.

The invention allows for obtaining a pH reduction or decrease in the brine, which is perfectly adjustable and homogeneously distributed throughout all the mass. Therefore, without the need of adding an extra amount of acid, which will be dangerous for the cell, it is possible to obtain a decrease of the oxygen content in chlorine up to the required values by an electrolysis operation in a easy and perfectly controlled way. At the same time, the pH of brine is homogenously low, for example 2 to 3 instead of 4 to 5 as in the prior art without the addition of hydrochloric acid, and the hypochlorite content in the brine is practically nil. The only form of active chlorine in the brine is represented by small amount of dissolved chlorine, normally lower than 0,1 g/l. As a consequence, the brine flowing into the cathodic compartment results in reduced amount of active chlorine which, thereafter, are transformed into chlorate. Therefore, as a final result, the produced caustic contains very low levels of chlorate, indicatively minor of one order than the normal levels typical of the operated cells of the prior art.

A further advantage of the invention is that the oxygen content in the chlorine and the chlorate in the brine are independent from the caustic concentration present in the cathodic compartment. The latter concentration, in fact, may be increased by increasing the operating temperature (higher water evaporation removed in the vapor state from the flow of gaseous hydrogen produced on the cathodes) and reducing the brine flow through the diaphragm (higher residence time of the liquid in the cell). Both methods determine a loss in the current efficiency resulting, in the prior art in an increase of the oxygen content in the chlorine and chlorate in the caustic. On the contrary, operating according to the present invention, the chlorine and caustic purities may be kept at the desired level by increasing in a suitable way the amount of hydrochloric acid added into the cell through the internal distributors, thus maintaining the brine pH at the above mentioned values. It has been surprisingly noted that by operating according to the invention, the loss in current efficiency caused by the increase of the caustic concentration in the cathodic compartments is quite minor with respect to the prior art operation.

Referring now to the drawing:

FIG. 1 is a frontal view of an electrolysis cell suitable for the process of the present invention.

A BRIEF DESCRIPTION OF THE DRAWING

In FIG. 1, the cell is comprised of a base (A) on which the dimensionally stable anodes (B) are secured by means of supports (Y). The cathodes, not shown as FIG. 1 is a frontal view, are formed by iron mesh coated with the diaphragm constituted by fibers and optionally a polymeric binder. The cathodes and the anodes are interleaved and a distributor (C) for the hydrochloric acid solution is disposed orthogonally to the hydrodynamic means (D). A multiplicity of distributors may be introduced in the cell in arrays placed side by side and more advantageously when higher is the number of anodes (B) arrays installed in the cell or, if preferred, longer is the cell itself or higher is the amperage of the current fed through the electrical connections ( R ). The perforations advantageously coincide with the middle of the passage (W) of the degassed brine (without entrained chlorine gas bubbles) downcoming to the base (A) from the anodes (B), (W) and (U) represent the length of the passage defined by the hydrodynamic means (D) respectively for the degassed brine and for the brine rich in gas which rises along the anodes.

The degassed brine is conveyed towards the base of the anodes ( B ) by means of downcoming duct ( E ) according to operation of the hydrodynamic means described in U.S. Pat. No. 5,066,378. In this way, an intense recirculation of the brine is obtained avoiding the formation of poor areas of current distribution. The symbol indicates both the level of the brine in the cell and the liquid zone where the degassing action of the brine rich in gas rising along the anodes is concentrated. By adjusting the level (P), an adequate flow of the brine through the diaphragm is maintained. The cover (G) of the cell defines the space wherein the produced chlorine is collected which is then sent through the outlet (H) to its utilization. The symbol shows the inlet of fresh brine. From the cell, a liquid of an aqueous solution of produced caustic and the residual sodium chloride is removed through a percolating outlet not shown in the figure.

The distributor of the solution of hydrochloric acid may also be longitudinally disposed with respect to the hydrodynamic means. The distributor of the present invention may be positioned over the level of the brine, but it is preferably below the brine level (P) over the hydrodynamic means to avoid that part of the hydrochloric acid may be evolved with the mass of gaseous chlorine. It is also evident that other hydrodynamic means, different from those described in U.S. Pat. No. 5,066,378, may be used so long as they are able to promote sufficient brine circulation.

It is to be noted that if hydrochloric acid is added to a cell not provided with any hydrodynamic means, it is not possible to obtain a significant reduction of the oxygen content in chlorine, even if the amount of acid fed to the cell is the same. On the other end, the amount of acid fed to the cell should be controlled both for economic reasons and not to damage the diaphragm, which is constituted by asbestos fibres and to avoid loss in current efficiency.

In the following examples, there are described several preferred embodiments to illustrate the invention. However, it should be understood that the invention is not intended to be limited to the specific embodiments.

EXAMPLE 1

The test was carried out in a chlor-alkali production line of diaphragm cells of the MDC55 type equipped with dimensionally stable anodes of the expandable type and provided with spacers to maintain the diaphragm anode surface distance equal to 3 mm. In this set-up, the anodes had a thickness of about 42 mm and the electrode surfaces were an expanded titanium mesh having a 1.5 mm thickness. The diagonals of the rhomboid openings of the mesh were equal to 7 and 12 mm. The electrode surfaces of the anodes were coated with an electrocatalytic film comprising oxides of metals of the platinum group.

The operation conditions were the following:

| | |
|---|---|
| asbestos fibers with fluorinated polymeric binder MS2 type, 3 mm thickness (measured in a dry condition) | |
| current density | 2200 A/m2 |

-continued

| | |
|---|---|
| average cell voltage | 3.40 V |
| feed brine | 315 g/l with a flow rate of about 1.5 m3/h |
| outlet solution | |
| caustic | 125 g/l |
| sodium chloride | 190 g/l |
| chlorate | about 1-1.2 g/l |
| average operating temperature | 95° C. |
| average oxygen content in chlorine | less than 4% |
| average hydrogen content in chlorine | less than 0.3% |
| average current efficiency | about 91% |

Six cells of the production line (A, B, C, D, E and F in the following) operating from 150 to 300 days were shut-down, opened and modified as follows:

cell A : four perforated tubes of polytetrafluoroethylene were introduced, secured to the cover, having the same length of the cell and orthogonally positioned with respect to the electrode surfaces of the anodes and having the same distance between each other;

cell B : some perforated tubes of polytetrafluoroethylene were introduced, secured to the cover, having the same length of the cell, their number being the same as the arrays of anodes. Said perforated tubes were positioned longitudinally with respect to the electrode surfaces of the anodes and centered in the middle of the anodes themselves as shown in FIG. 1;

cell C : four perforated tubes were introduced as in cell A. Moreover, each anode was equipped with a hydrodynamic means of the type described in U.S. Pat. No. 5,066,378 and orthogonally disposed with respect to the electrode surfaces of the anodes;

cell D : perforated tubes were introduced as in cell B. Moreover, each anode was equipped with hydrodynamic means as in cell C;

cell E: same changes as in cell C, with the elimination of the spacers. Therefore, the electrode surfaces of the anodes were generally in contact with the corresponding diaphragms;

cell F: same changes as in cell D, with the elimination of the spacers as in cell E;

All the six cells were furthermore equipped with suitable sampling outlets to allow for taking anolyte from some parts of the cells, particularly, from the points corresponding to reference (W) and (U) of FIG. 1, such as respectively the area of the downcoming degassed brine and the area of the brine rich in chlorine bubbles upcoming to the anodes.

The six cells were started-up and kept under control until the normal operating conditions were reached, particularly as to the oxygen content in chlorine and the chlorate concentration in the produced caustic.

After inserting the PTFE perforated tubes, a 33% hydrochloric acid solution was added, with the following results.

In cells A and B, there was not noted a significant reduction of the oxygen content in chlorine or chlorates in the produced caustic, even with a hydrochloric acid load exceeding the caustic back-migration. This surprising negative result may be explained by the pH values measured on the brine sampling taken from different points of the cell. In particular, the pH of the upcoming brine from to anodes was normally in the range from 4 to 4.5 as before the addition of hydrochloric acid, excluding some points where the pH decreased to extremely low values, near to zero. This situation is the result of an insufficient internal recirculation and, therefore, of non-uniformity of the added acidity. The test was suspended after a few hours because very low pH values damaged the diaphragms.

Cells C, D, E and F, before starting the acidification procedure, were characterized by an oxygen content in the chlorine equal to 2.5% and by a current efficiency of about 94%. The oxygen in the chlorine decreased quickly to 0.3–0.4% when the addition of an amount of hydrochloric acid slightly greater than the amount of caustic which back-migrated through the diaphragms. The pH value of brine samples taken from different areas of the cells was practically constant and was between 2.5 and 3.5. Moreover, the chlorate concentration in caustic strongly decreased to values fluctuating from 0.05 and 0.1 g/1.

It was surprisingly found that the current efficiency with the addition of hydrochloric acid was 96%, about 2% greater than the efficiency measured before the addition of hydrochloric acid. To confirm this result, the addition of hydrochloric acid was stopped and the oxygen content and the current efficiency were measured after the adjustment of the operating parameters. The values were equal to the initial values fluctuating around 2.5% for the oxygen in the chlorine and 94% for the current efficiency. The fact that the results are equivalent for the two pairs of cells, respectively C, D and E, F, demonstrates that the distance between the diaphragms and the electrode surfaces of the anodes does not affect significantly the correlation between the added hydrochloric acid and the oxygen in the chlorine, only if the anodes are provided with suitable hydrodynamic means.

EXAMPLE 2

Cells E and F of example 1 were shut-down and the hydrodynamic means, orthogonally to the electrode surface of the anodes, were substituted with similar types positioned longitudinally to the electrode surfaces, particularly along the middle of the anodes themselves. Then the cells where started-up and the same procedure of adding hydrochloric acid was carried out as described in example 1.

The results were very similar to the positive ones of example 1, confirming that the action of the addition of hydrochloric acid does not depend on the type of hydrodynamic means, but on the efficiency of the internal recirculation resulting in the homogeneous acidity in the brine.

After about 15 days of operation, the fresh brine load to the two cells was decreased to 1.4 $m^3$/hours and the temperature was increased to 98° C.

Under these conditions, the outlet liquid from the cell contained about 160 g/1 of-caustic and about 160 g/l of sodium chloride. The two cells, without the addition of hydrochloric acid, were characterized by an oxygen content in the chlorine of about 3.5% and by a current efficiency in the order of 92%. With the addition of hydrochloric acid, the oxygen content in the chlorine decreased to 0.3–0.4%, and at the same time, the current efficiency was 95%. Moreover, the pH values of the brine samples taken from different points of the cell at various times were from 2.5 to 3.5 and the chlorates concentration in the brine was maintained around 0.1–0.2 g/l.

EXAMPLE 3

One of the two cells of example 2, after stabilization of the operating conditions by adding acid and with an outlet liquid containing 125 g/l of caustic and 190 g/l of sodium chloride at 95° C., was fed with fresh brine containing 0.01 g/l of iron instead of the normal values of about 0.002 g/l. In the following 72 days of operation, the hydrogen content in chlorine was kept under control with particular attention: this was constant and less than 0.3%.

The same addition of iron to one of the conventional cells installed in the some electrolytic circuit caused a progressive increase of hydrogen in chlorine up to 1%; at which point, the addition of iron to the fresh brine was discontinued.

Various modifications of the cell and process of the invention may be made without departing from the spirit or scope thereof and it should be understood that the invention is intended to be limited only as defined in the appended claims.

We claim:

1. In a process of chlor-alkali electrolysis carried out in a diaphragm cell, comprising pairs of interleaved anodes and cathodes, said cathodes are provided with openings and coated with a porous diaphragm resistant to corrosion, said diaphragm dividing the cell into a cathodic compartment and an anodic compartment, the anodes are either expandable or non-expandable said cell having inlets for feeding fresh brine, and outlets for removing produced chlorine and hydrogen and caustic where the caustic includes a concentration of chlorine and chlorate, the improvement comprising controlling oxygen content in the chlorine and chlorate concentration in the caustic independently from the flow rate and the concentration of the said fresh brine by equipping each anode with hydrodynamic means and downcoming ducts and by adding an aqueous solution of hydrochloric acid to the brine in the anodic compartment of the cell through distributors positioned over said hydrodynamic means.

2. The process of claim 1 wherein distributors are tubes having perforations, said tubes are positioned beneath the level of liquid in the cell.

3. The process of claim 1 wherein said hydrodynamic means are orthogonally positioned with their respective longitudinal axis in an orthogonal with respect to the electrode surfaces of the anodes.

4. The process of claim 1 wherein the hydrodynamic means are positioned with their respective longitudinal axis parallel to electrode surface of said anodes.

5. The process of claim 1 wherein the distributors are orthogonally oriented along their respective longitudinal axis with respect to electrode surface of said anodes.

6. The process of claim 1 wherein the distributors are oriented with their respective longitudinal axis parallel with respect to electrode surface of said anodes.

7. The process of claim 1 wherein a distributor is provided to each of said hydrodynamic means.

8. The process of claim 1 wherein the said perforations are in correspondence to each of said hydrodynamic means.

9. The process of claim 1 wherein the fresh brine contains iron in a concentration higher than 0.01 g/l.

10. The process of claim 1 wherein the amount of hydrochloric acid to reduce the oxygen level in the chlorine to less than 0.5% volume, the chlorate concentration in the produced caustic less than 0.2 g/l and to keep a uniform pH of the brine in the anodic compartment in the range of 2.0–3.0, is slightly greater than the amount of caustic back migrating through the diaphragm.

11. A diaphragm cell for chlor-alkali electrolysis, comprising pairs of interleaved anodes and cathodes provided with openings, said cathodes provided with openings and each cathode is coated with a porous diaphragm resistant to corrosion, said diaphragm dividing the cell into a cathode compartment and an anode compartment, said anodes are either expandable or non-expandable, the cell having an inlet for feeding fresh brine and outlets for removing chlorine and hydrogen and caustic, characterized in that each anode of the cell is equipped with hydrodynamic means and down coming ducts and is provided with distributors for acid positioned over said hydrodynamic means to uniformly lower the pH of the brine in the anodic compartment.

12. The cell of claim 11 wherein the distributors are tubes having perforations positioned beneath brine level in the cell.

13. The cell of claim 12 wherein said perforations are in correspondence to each of said hydrodynamic means.

14. The cell of claim 11 wherein said hydrodynamic means are orthogonally positioned with their respective longitudinal axis with respect to the electrode surfaces of said anodes.

15. The cell of claim 11 wherein said distributors are oriented with their respective longitudinal axis parallel with respect to electrode surfaces of the anodes.

16. The cell of claim 11 wherein a distributor is provided for each hydrodynamic means.

17. The cell of claim 11 wherein the distributors are orthogonally oriented with their respective longitudinal axis with respect to the electrode surfaces of the anodes.

* * * * *